US007052204B2

(12) United States Patent
Lutz

(10) Patent No.: US 7,052,204 B2
(45) Date of Patent: May 30, 2006

(54) PORTABLE VIBRATORY SCREED WITH VIBRATION RESTRAINT

(75) Inventor: Todd J. Lutz, Oconomowoc, WI (US)

(73) Assignee: Wacker Corporation, Menomonee Falls, WI (US)

( * ) Notice: Subject to any disclaimer, the term of this patent is extended or adjusted under 35 U.S.C. 154(b) by 0 days.

(21) Appl. No.: 10/773,012

(22) Filed: Feb. 4, 2004

(65) Prior Publication Data

US 2005/0169707 A1 Aug. 4, 2005

(51) Int. Cl.
*E01C 19/22* (2006.01)

(52) U.S. Cl. ..... 404/118; 404/114

(58) Field of Classification Search ..... 404/97, 404/118, 133.05, 133.1, 114
See application file for complete search history.

(56) References Cited

U.S. PATENT DOCUMENTS 4,213,749 A * 7/1980 Morrison ..... 425/456
4,340,351 A * 7/1982 Owens ..... 425/456
4,386,901 A * 6/1983 Morrison ..... 425/456
5,244,305 A * 9/1993 Lindley ..... 404/97
5,345,684 A * 9/1994 Shoup et al. ..... 30/276
5,984,571 A * 11/1999 Owens ..... 404/97
6,089,787 A * 7/2000 Allen et al. ..... 404/118
6,698,531 B1 * 3/2004 Kurten ..... 173/113

* cited by examiner

*Primary Examiner*—Raymond Addie
(74) *Attorney, Agent, or Firm*—Boyle Fredrickson Newholm Stein & Gratz S.C.

(57) ABSTRACT

A portable vibratory screed machine is provided with a vibration restraint operable to reduce undesirable vibration of the engine and to extend the life of the engine. The portable vibratory screed machine includes a machine frame having a reference structure. The machine further includes an engine mounted on the reference structure via a mount that surrounds a drive shaft that is driven by the engine's output. A vibratory assembly remotely located from the engine is powered by the engine to vibrate a screed plate. The vibration restraint directly couples the engine housing to the reference structure at a location that is spaced apart from the mount.

16 Claims, 4 Drawing Sheets

PORTABLE VIBRATORY SCREED WITH VIBRATION RESTRAINT

BACKGROUND OF THE INVENTION

1. Field of the Invention

The invention relates to a portable vibratory screed machine, and, more particularly, relates to a portable vibratory screed machine having a vibration restraint configured to reduce undesirable vibrational wear on and extend the life of the machine's engine.

2. Discussion of the Related Art

Numerous screed machines employ vibratory action to tamp and smooth concrete in the strike off step of a concrete finishing operation. Known vibratory screed machines comprise, for instance, an elongated blade extending horizontally and transversally at lower ends of a pair of handles adapted to be hand held and operated for displacing the wet screed over a concrete surface. A motor is provided above the blade and between the handles. The motor's output extends to the blade, where it is connected to a vibratory assembly having one or more eccentric weights configured to impart vibrations to the screed blade upon motor operation. A handle permits an easy and constant correction of the level of the concrete with minimum effort. A throttle control is provided at the handle such that the speed of the motor may be adjusted as the blade is displaced over the concrete being surfaced.

One specific example of a known vibrating plate machine is disclosed in U.S. Pat. No. 4,340,351, which describes a vibratory concrete screed used in the final finishing of concrete. This screed requires two operators. As another example, U.S. Pat. No. 4,641,995 describes a vibratory concrete screed, which rides on forms to screed narrow strips of concrete, such as walks. This screed is mounted on the operator via a complicated harness counter-weighted frame and is powered by electricity. As a result, the screed requires electrical power, and the screed requires manipulation of lengthy extension cords. These and other screeds are designed to be used only after concrete has been leveled and preliminarily tamped. None of these screeds is suitable to "wet screed" large slabs of freshly poured concrete that has not yet been leveled or tamped at all.

In the absence of widely accepted wet screeding machines, the industry standard for wet screeding is to perform that process manually. Typically, in manual wet screeding, a 2-inch by 4-inch board that is 8-foot to 20-foot long is manipulated manually by one or two men hand working in conjunction with as many as four laborers, known as "puddlers," who push the fresh concrete in place with concrete rakes. The hand puddling and wet screeding process is slow, inefficient, labor intensive, and extremely fatiguing, particularly if large slabs are poured and finished over the course of an entire day or more. It is also often requires the addition of more water to the concrete mix to make it more workable. The addition of water to produce slumps of 6-inch to 8-inces is common in the industry to increase the workability of the concrete, allowing the finisher to effectively hand "wet screed" the fresh concrete. The hand process typically limits the finisher to the average pour of 6,000 to a maximum of 8,000 square feed of slab per day for crew of six. The additional water reduces the strength of the concrete, causing voids and weak spots in the cured concrete.

Proposals have been made to reduce the labor required for wet screeding by providing portable vibratory "wet screed" machines. These machines typically have an engine coupled to an drive shaft. The engine is generally an internal combustion engine having a housing, a fuel tank, a clutch housing, etc. The drive shaft is configured to drive a vibrator drive shaft of the vibratory assembly. The engine housing or a support therefore is secured to a housing for the vibrator drive shaft at one point by a clamp. The clamp location is approximately midway between a centroid of the engine and the blade. The clamp provides only limited restraint to the engine and drive shaft relative to the vibratory assembly along the x-y reference plane. Vibrations generated upon screed operation by the eccentric vibratory assembly therefore are transmitted to the clamp point and generate severe vibrations on the engine about all three (x, y, z) axes. The vibrations are known to cause failures not only in the clutch housing, but also of the handle assembly, the fuel tank, oil seals, the engine block, etc. Engine block failures are the most problematic because the engine is by far the most expensive component of the wet screed. The screed therefore is typically considered spent when the engine block fails. Vibratory wet screeds therefore historically have had a reputation of being unreliable, hindering their acceptance by the industry as a whole.

In light of the foregoing, a portable vibratory screed machine is desired with reduced undesirable vibration on the motor and extended motor life associated with operation of the vibratory screed machine in the surfacing of concrete.

SUMMARY OF THE INVENTION

The present invention provides an improved portable vibratory screed having a vibration restraint configured to reduce undesirable vibration on the engine and to extend the engine's life. The apparatus is ideally suited for use with wet screeds, but is usable with other vibratory screed machines as well.

In accordance with a first aspect of the invention, one or more of the above-identified needs is met by providing a vibration restraint configured for mounting on a portable vibratory screed machine powered by an engine mounted on a frame, the engine coupled to an drive shaft configured to drive a vibratory assembly, the vibratory assembly coupled to the frame and a screed plate for surfacing a poured concrete surface, the vibration restraint configured to reduce vibration of the engine. The vibration restraint is radially spaced from the drive shaft and has a first end and a second end opposite the first end. The first end is coupled to the engine housing and the second end coupled to the platform assembly.

In accordance with a second aspect of the invention, a portable vibratory screed machine includes a machine frame having a reference structure, an engine including a drive shaft and being mounted on the reference structure via a mount that surrounds the drive shaft, a vibratory assembly located remote from the engine, the vibratory assembly powered by the engine to vibrate, and a vibration restraint configured to restrain vibration of the engine. The vibration restraint directly couples the engine to the reference structure at a location that is spaced apart from the mount.

The resulting portable vibratory screed machine of the present invention has several advantages over prior vibratory plate machines. The vibratory plate does not interfere with or hinder normal operation of the portable vibratory screed machine. Further, the vibratory plate reduces the imposition of undesirable vibrations on the engine and thereby extends the engine life.

In accordance with a third aspect of the invention, the present invention provides a method of extending a life of an engine having a drive shaft configured to drive a portable vibratory assembly. The engine is mounted on a reference structure of the portable vibratory screed machine. The method includes the acts of operating the engine to drive the vibratory assembly to generate vibrations, and restraining the engine relative to the vibratory assembly in a direction generally parallel to a central axis of the drive shaft. The act of restraining can include providing a restraint having a first end and a second end, coupling the first end of the restraint to the engine, and coupling the second end of the restraint to the reference structure.

Other features and advantages of the invention will become apparent to those skilled in the art from the following detailed description and accompanying drawings. It should be understood, however, that the detailed description and specific examples, while indicating the preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

A wide variety of vibration restraints for screeds could be constructed in accordance with the invention as defined by the claims. Hence, while preferred embodiments of the invention will now be described with reference to a portable vibratory wet screed machine, it should be understood that the invention is in no way so limited. For instance, it is also usable with a variety of different vibratory screed machines that are potentially subject to undesired engine vibration.

Figure 1:
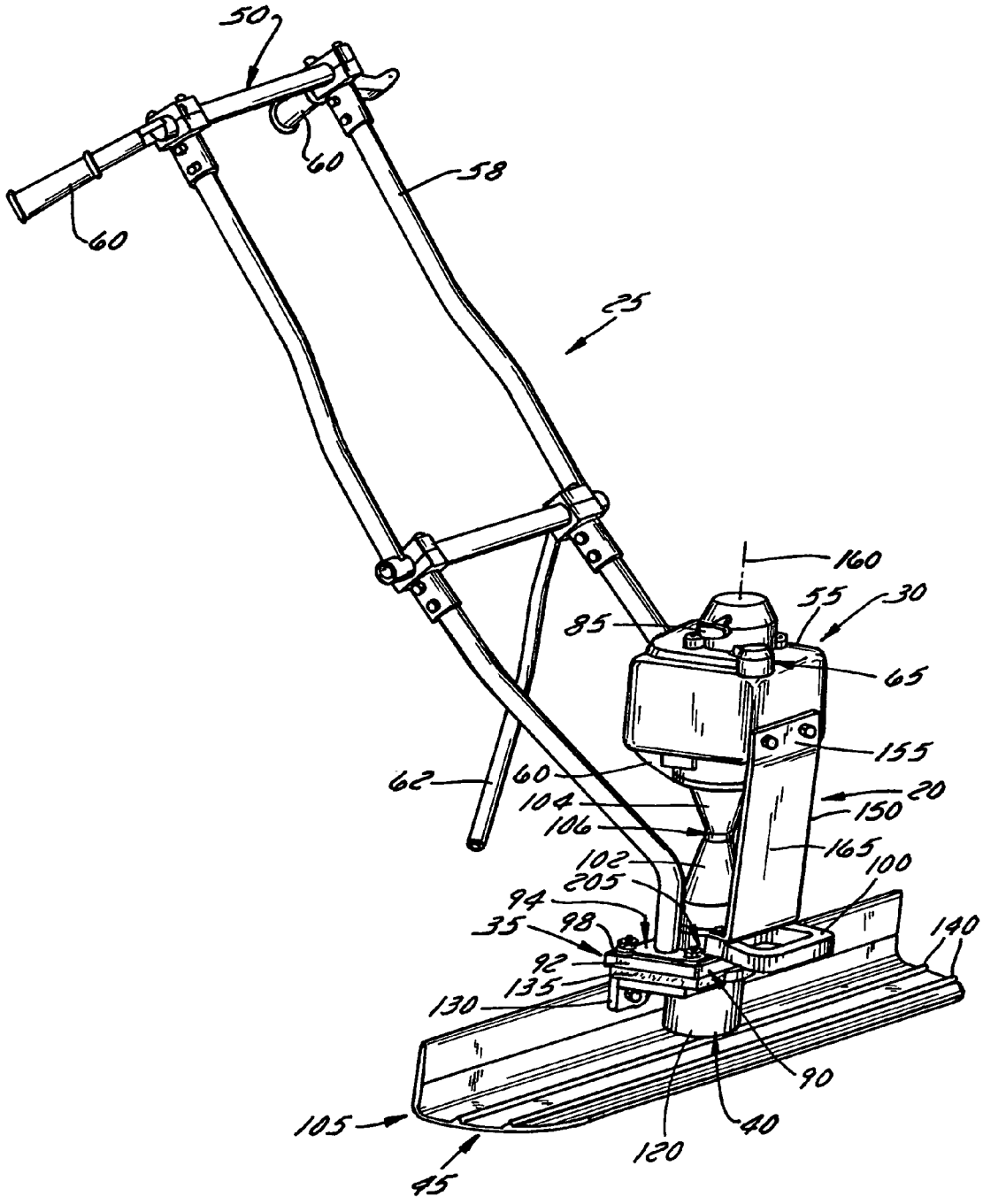
FIG. 1 is a perspective view of an assembled portable vibratory screed machine and vibration restraint in accordance with the present invention.

FIG. 1 illustrates a perspective view of a vibration restraint 20 constructed in accordance with one embodiment of the invention and coupled to a portable vibratory wet screed machine 25. In general, the portable vibratory screed machine 25 includes an engine 30 mounted on a frame 35. The machine 25 further includes an elongated surfacing screed blade 45 coupled to a vibratory assembly 40. The engine 30 is operable to power the vibratory assembly 40 to impart vibratory movement to the blade 45 such that, when the blade 45 is maneuvered over a freshly poured (wet) concrete surface, the blade 45 is operable to provide a smooth, finished surface to the wet concrete. The vibratory screed machine 25 is controlled by an operator via a handle assembly 50 extending several feet from the frame 35. The handle assembly 50 includes a frame 58 connected to the frame 35 at its lower end and terminating at its upper end in the handgrips 60, and a kickstand 62 pivotally attached along the frame 58 to directly support a distal end 105 of the screed blade 45 on the ground.

Figure 2:
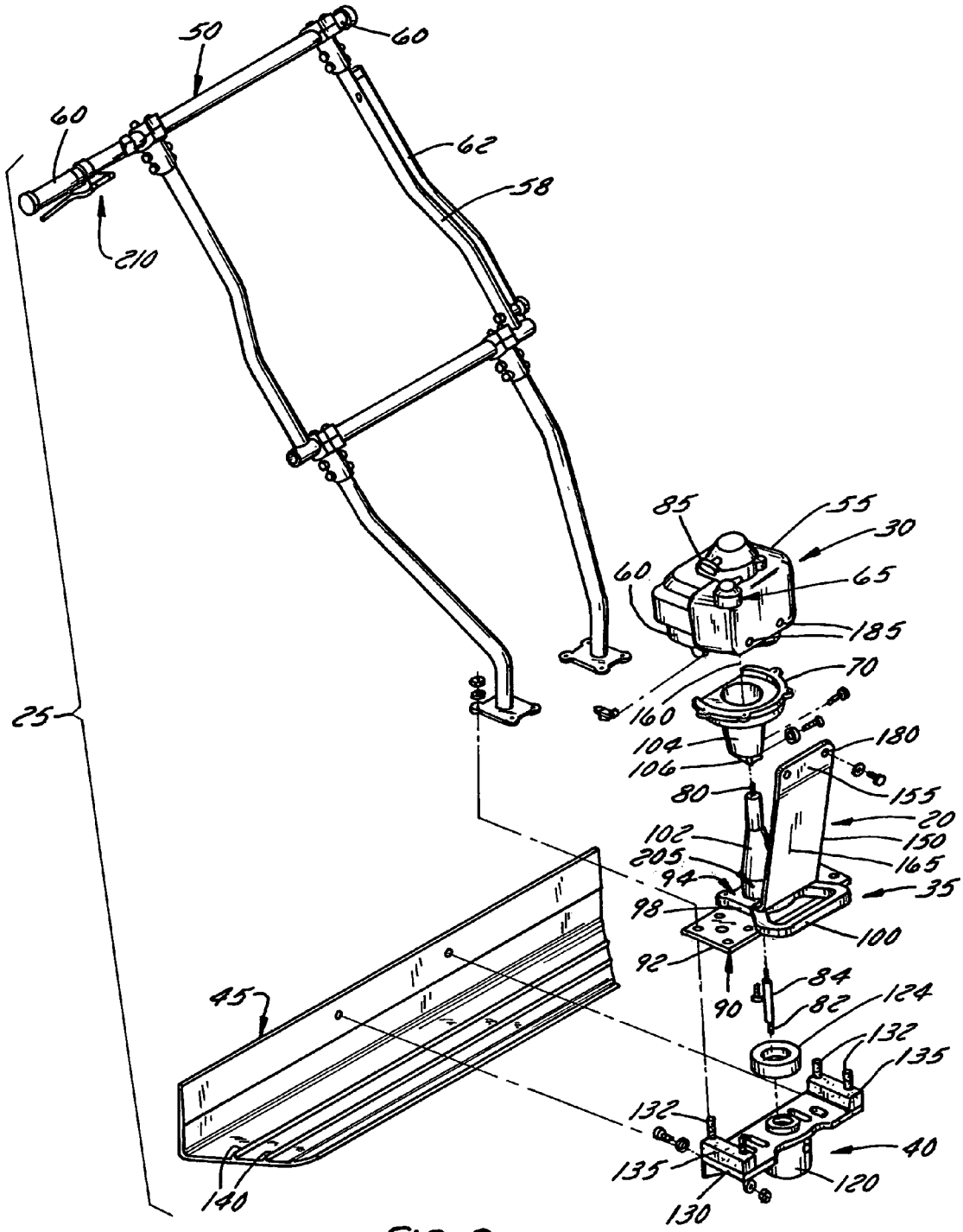
FIG. 2 is an exploded perspective view of the portable vibratory screed machine shown in FIG. 1.
Figure 3:
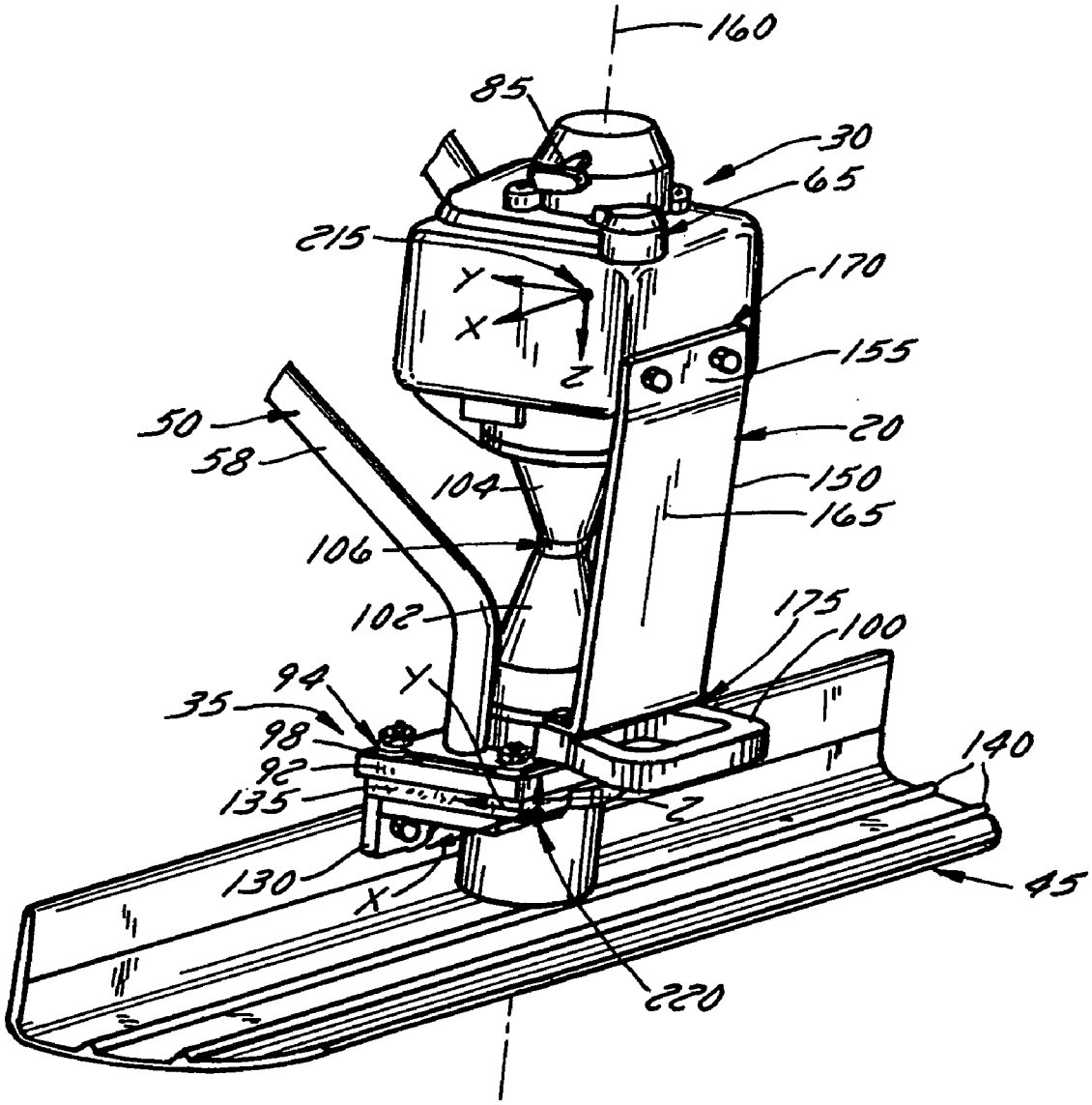
FIG. 3 is a detailed perspective view of the portable vibratory screed machine shown in FIG. 1 illustrative of testing reference points for vibration restraint effectiveness.
Figure 4:
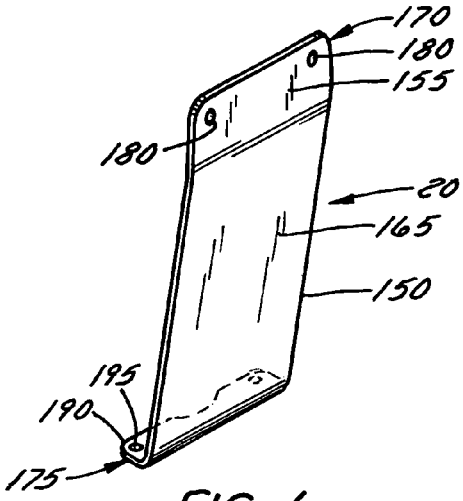
FIG. 4 is a detailed perspective view of the vibration restraint in FIG. 1.
Figure 6:
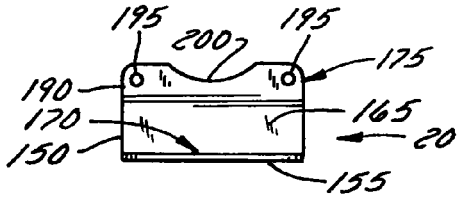
FIG. 6 is a top view of the vibration restraint in FIG. 4.
Figure 5:
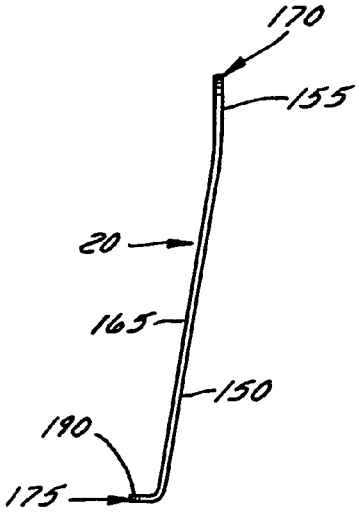
FIG. 5 is a side view of the vibration restraint in FIG. 4.
Figure 7:
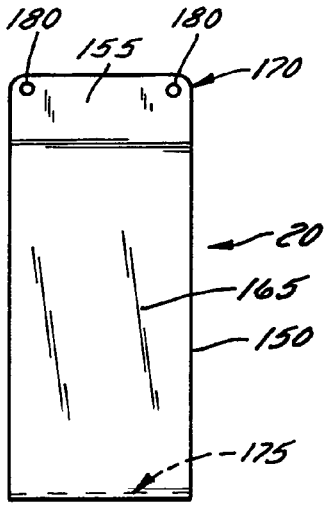
FIG. 7 is a front view of the vibration restraint in FIG. 4.

A preferred engine 30 is a 4-stroke internal combustion engine of the type generally used for a portable vibratory screed machine. The engine 30 generally includes a housing or engine block 55, a crankcase 60, a fuel tank 65, a clutch housing 70, and a conventional air supply system (not shown). The clutch couples the engine output shaft (not shown) to a generally vertical drive shaft 80. The drive shaft 80, in turn, is coupled to an input shaft 82 of the vibratory assembly 40 by a flex joint 84 (FIG. 2). The engine 30 additionally includes an ignition system which, in the present example, comprises a manual pull starter 85. The engine 30 may be power by gasoline or other fuels.

The frame 35 includes a platform assembly 90 that is supported on the screed blade 45 by a blade adapter bracket assembly 130. The blade adapter bracket assembly 130 is attached to the bottom of platform assembly 90 by conventional fasteners 132 and is vibrationally separated from the frame 35 by vibrational isolators such as elastomeric shock mounts 135. The platform assembly 90 includes a mount plate 92 and a lift handle 94. The lift handle 94 includes an annular collar 98 and a grip 100 extending outwardly from the collar 98. The handle 94 is reversible so that the grip 100 can extend either forwardly of the screed as shown or rearward therefrom. The engine 30 is supported on the mount plate 92 via a lower frustoconical shaft housing 102 and a complimentary frustoconical base 104 of the clutch housing 70. The base 104 is attached to the upper end of the housing 102 by a clamp assembly 106.

The vibratory assembly 40 is preferably an eccentric mass assembly rotationally coupled to the drive shaft 80 by the above-described flex joint 84 and input shaft 82. The exciter assembly 40 may, for instance, comprise a set of adjustable eccentric weights and one or more fixed eccentric weights (not shown). The exciter assembly 40 is contained within an eccentric cover 120. The eccentric cover 120 is attached to the underside of the blade adjuster bracket assembly 130 in a conventional manner. A flexible sealing ring 124 prevents concrete, dirt, and other foreign materials from invading the interior of the vibratory assembly 40.

The screed blade 45 is generally L-shaped on cross sectional view, having a top surface, a finishing surface, a cutting edge, and trailing edge. Structural gussets 140 extend the length of the blade providing more uniform transmission of vibrational energy. Adapters may be employed to connect the blade adapter bracket assembly 130 to different shaped screed blades.

The engine 30 is restrained from vibration by the above-described vibration restraint 20, which provides additional support to the engine 30 beyond that provided by the clamp assembly 106. The vibration restraint 20 preferably couples the engine 30 to the frame 35. A preferred vibration restraint 20 includes a plate 150 generally shaped to conform to the contours of the vibratory screed machine. Specifically, as best seen in FIGS. 4–7, the plate 150 includes a first portion 155 aligned in a generally co-linear direction relative to a central axis 160 of the drive shaft 80, and a second portion 165 inclined with respect to the first portion 155 to conform to a narrower portion of the vibratory screed machine 25. The shape of the plate 150 (e.g., curvilinear, etc.) can vary. The plate 150 is preferably formed from steel, but could be formed from aluminum or another metal or another material entirely. The first portion 155 of the plate 150 terminates at a first, upper end 170, and the second portion 165 of the plate 150 terminates at a second, lower end 175. The first end 170 includes a pair of openings 180 configured to receive fasteners coupling the plate 155 to existing taps 185 in the engine housing 55. The second end 175 includes a flange portion 190 having a pair of openings 195 configured to receive fasteners coupling the plate 150 to the platform assembly 90. The flange 190 includes a curvilinear cutout portion 200 configured to receive a lower cylindrical end 205 of the shaft housing 102 (FIGS. 1 and 2). The types of fasteners (e.g., spot welds, etc.) can vary. The vibration restraint 20 preferably is attached to the engine housing 55 using existing taps 185 in the engine housing 55 and is attached to the platform assembly 90 using existing fasteners on the platform assembly 90. However, additional/and or other fasteners can be used apart from the illustrated fasteners. Structures supplementing or replacing the plate 150 could also be used as a vibrational restraint, so long as the structure(s) provide support for the engine 30 in addition to that provided by the clamp assembly 106.

The vibration restraint 20 is also configured to reduce undesirable vibration on clutch housing 70 and the engine 30 caused by vibrations from the eccentric movement of the vibratory assembly 40. Specifically, the plate 150 restrains vibration in a direction generally parallel to the central axis 160 of the drive shaft 80 but in a plane different from the drive shaft 80. The resultant load bearing triangulation and redundancy reduces the vibrational movement of the engine 30 and thereby enhances the engine's operating life.

In operation, an operator can initiate start-up of the engine 30 by either activating an automatic starter or pulling the manual pull starter system 85. Clutch engagement causes the engine 30 to drive rotation of the drive shaft 80 at a standard operating speed ranging from 4,000 to 8,000 rpm, but preferably in a standard operating range of 5,000 to 6,000 rpm. The rotating drive shaft 80 causes the flex coupling 84 and vibratory assembly input shaft 82 to rotate. The shaft 82 in turn drives rotation of the adjustable eccentric weights and the fixed eccentric weights of the vibratory assembly 40, thereby imparting vibrations to the bracket blade adapter assembly 130 and thus to the screed blade 45. The vibration isolators 135 reduce the magnitude of vibrations transmitted to the handle assembly 50 and the operator.

Engine speed and, hence, the frequency and intensity to the vibrations are controlled by a throttle control lever 210 attached to the handle assembly 50. The action of the throttle control lever 210 is transmitted to the engine 30. The vibrational force is transmitted through the blade adapter assembly 130 and along the screed blade 45, where structural gussets 140 strengthen blade 45 and apply the vibrational force evenly across the poured concrete.

The vibration restraint 20 of the portable vibratory screed machine 25 is operable to reduce undesirable vibration and associated wear and extends the engine life. This response is considered adequate for operating portable vibratory screed machines.

Tests indicate the vibration restraint 20 is operable to dramatically reduce the undesired vibration experienced by the engine 30. In these tests, movements of both the engine 30 and the mount plate 92 were measured along x, y, z reference points 215 and 220 at the engine 30 and at the mount plate 92 of the platform assembly 90, respectively. At an engine operating speed of 5,000 rpm (the low end of the standard operating speed of the disclosed wet screed), the results, measured in units of gravitation acceleration (g's), are reflected in Table 1:

TABLE 1

| | Vibration Reduction at 5,000 rpm, | | | |
|---|---|---|---|---|
| | STANDARD SCREED | | SCREED w/VIBRATION RESTRAINT | |
| | ENGINE | BASE | ENGINE | BASE |
| X | 2.2 | 1.9 | 2.7 | 2.0 |
| Y | 7.3 | 9.4 | 4.1 | 7.8 |
| Z | 7.5 | 2.8 | 3.1 | 4.0 |
| SUM | 10.7 | 10.0 | 5.8 | 9.0 |

At an engine operating speed of 6,000 rpm, the results measured in units of gravitation acceleration, are reflected in Table 2:

TABLE 1

| | Vibration Reduction at 6,000 rpm | | | |
|---|---|---|---|---|
| | STANDARD SCREED | | SCREED w/VIBRATION RESTRAINT | |
| | ENGINE | BASE | ENGINE | BASE |
| X | 3.4 | 2.3 | 3.1 | 2.1 |
| Y | 5.6 | 7.0 | 4.0 | 6.3 |
| Z | 9.5 | 1.8 | 3.8 | 3.3 |
| SUM | 11.5 | 7.6 | 6.3 | 7.4 |

In reducing vibrational forces on the engine 30 and the clutch housing 70, the test results also show that the vibration restraint 20 is operable to increase the operating life of the engine 30 by a factor of two to eight times relative to the standard operating life of an engine of the same portable vibratory screed assembly without the vibration restraint 20. Tests were performed on portable vibratory wet screed machines configured as described above but lacking a vibration restraint and on corresponding portable vibratory wet screed machines having the vibration restraint 20. The engines were operated at a standard operating speed of 5,000 to 6,000 rpm, and the blades were submerged in foam and water to simulate concrete. The types of machines tested varied in length of screed blade (e.g., 6 foot to 10 foot) and varied settings of the exciter (i.e., half to full setting). The test results show that engines of a portable vibratory screed machines lacking a vibration restraint exhibit, on average, an operating life of 35 to 50 hours. In comparison, engines of corresponding portable vibratory screed machines having the vibration restraint 20 typically demonstrated operational lives of 175 to 400 hours or even more. Forty percent of the engines of the sampled machines exhibited operating lives that exceeded 200 hours. Several of the tests, exceeding 400 hours, ended without failures.

As indicated above, many changes and modifications may be made to the present invention without departing from the spirit thereof. The scope of some of these changes is discussed above. The scope of others will become apparent from the appended claims.

I claim:

1. A portable vibratory screed machine, comprising:

(A) a screed blade;

(B) a machine frame mounted on the screed blade;

(C) an engine including a rotational output and an engine housing;

(D) a vibratory assembly which is mounted on the machine frame, which is located remote from the engine, and which impacts vibrations to the screed blade;

(E) a drive shaft that transmits torque from the engine output to the vibratory assembly (F) an engine mount which surrounds the drive shaft and which supports the engine on the machine frame; and (G) a vibration restraint which is attached to the engine housing and which is attached to the machine frame at a location that is transversely spaced from a bottom of the engine mount thereby to restrain the engine from vibrating in a direction that is at least generally parallel to a central axis of the drive shaft.

2. The portable vibratory screed machine of claim 1, wherein the engine mount is supported on a mount plate of the machine frame, and wherein the restraint has a first end attached to the engine housing and a second end terminating in a flange that is configured to receive fasteners coupling the flange to the mount plate.

3. The portable vibratory screed machine of claim 2, wherein the restraint comprises a plate having first and second ends, the first end being directly coupled to the engine housing and the second end being directly coupled to the mount plate by the fasteners.

4. The portable vibratory screed machine of claim 3, wherein a portion of the plate is shaped to generally conform to a contour of a mating portion of the engine housing.

5. The portable vibratory screed machine of claim 4, wherein the restraint is configured to restrain vibration in a direction generally parallel to the central axis of the drive shaft independent of the engine mount.

6. The portable vibratory screed machine of claim 1, wherein, when the engine operates at a speed of 5,000 to 6,000 rpm, the vibration restraint is operable to at least double an operational life of the engine relative to an engine of the same portable vibratory screed machine without a vibration restraint.

7. The portable vibratory screed machine of claim 6, wherein the vibration restraint is operable to quadruple a life of the engine.

8. The portable vibratory screed machine of claim 1, wherein, when the engine operates in a range of 5,000 to 6,000 rpm, the vibration restraint is operable to reduce engine vibration by at least forty percent.

9. The portable vibratory screed machine of claim 1, wherein, when the engine operates in a range of 5,000 to 6,000 rpm, the vibration restraint is operable to reduce engine vibration by at least twenty-five percent.

10. The portable vibratory screed machine of claim 1, wherein, when the engine operates in a range of 5,000 to 6,000 rpm, the vibration restraint is operable to extend a life of the engine to at least 200 operating hours.

11. The portable vibratory screed machine of claim 1, wherein the vibrating restraint comprises a metal plate having first portion and a second portion, the first portion being inclined relative to the second portion, and a flange coupled to the second portion and having openings configured to receive fasteners coupling the flange to the reference structure.

12. A method of operating an engine of a vibratory plate machine, the vibratory plate machine having a screed blade, a machine frame mounted on the screed blade, a vibratory assembly, a drive shaft that couples the engine to the vibratory assembly, and an engine mount that surrounds the drive shaft and that supports the engine on the machine frame the method comprising:

providing a restraint having a first end and a second end, coupling the first end of the restraint to the engine, and coupling the second end of the restraint to the machine frame, operating the engine to drive the vibratory assembly to generate vibrations that are imparted to the screed blade; and, during engine operation, restraining the engine relative to the vibratory assembly in a direction generally parallel to a central axis of the drive shaft using said restraint that couples the engine to the machine frame at a location that is transversely spaced from the engine mount.

13. The method of claim 12, wherein the act of restraining includes reducing vibrational movement of the engine by at least 40 percent relative to operating the same portable vibratory machine without performing the act of restraining.

14. A portable vibratory screed machine, comprising:

(A) a screed blade;

(B) a machine frame mounted on the screed blade;

(C) an engine including a rotational output and an engine housing;

(D) a vibratory assembly which is mounted on the machine frame, which is located remote from the engine, and which impacts vibrations to the screed blade;

(E) a drive shaft which transmits torque from the engine output to the vibratory assembly (F) an engine mount which surrounds the drive shaft and which supports the engine on the machine frame;

(H) a vibration restraint which is attached to the engine housing and which is attached to the machine frame at a location that is transversely spaced from a bottom of the engine mount thereby to restrain the engine from vibrating in a direction that is at least generally parallel to a central axis of the drive shaft; and a handle assembly which is mounted on the machine frame.

15. The method of claim 12, further comprising guiding the portable screed assembly using a handle assembly mounted on the machine frame.

16. A portable vibratory screed machine, comprising:

(A) a screed blade;

(B) a machine frame mounted on the screed blade;

(C) an engine including a rotational output and an engine housing;

(D) a vibratory assembly located remote from the engine and mounted on the machine frame;

(E) an at least generally vertically extending drive shaft that transmits torque from the engine output to the vibratory assembly;

(F) an at least generally vertically extending engine mount that surrounds the drive shaft, that extends upwardly from the machine frame, and to which the engine is clamped;

(G) a vibration restraint that is attached to the engine housing and to the machine frame at a location that is transversely spaced from a bottom of the engine mount thereby to restrain the engine from vibrating in a direction that is at least generally parallel to a central axis of the drive shaft.

* * * * *

UNITED STATES PATENT AND TRADEMARK OFFICE

CERTIFICATE OF CORRECTION

PATENT NO. : 7,052,204 B2
APPLICATION NO. : 10/773012
DATED : May 30, 2006
INVENTOR(S) : Lutz It is certified that error appears in the above-identified patent and that said Letters Patent is hereby corrected as shown below:

IN THE CLAIMS

| | |
|---|---|
| CLAIM 11<br>Col. 7, Lines 59-60 | Replace the words "the reference structure" with -- the machine frame -- |
| CLAIM 14<br>Col. 8, Line 33 | Replace the text "(H)" with -- (G) -- |
| CLAIM 14<br>Col. 8, Line 39 | Insert the text -- (H) -- before the words "a handle assembly ..." |

Signed and Sealed this

Twelfth Day of February, 2008

JON W. DUDAS
*Director of the United States Patent and Trademark Office*